US006285126B1

(12) United States Patent
Evans et al.

(10) Patent No.: US 6,285,126 B1
(45) Date of Patent: Sep. 4, 2001

(54) LAMP WITH MERCURY RELEASE STRUCTURE AND METHOD FOR DISPENSING MERCURY INTO A LAMP

(75) Inventors: Tyra Newman Evans, Versailles; Joseph L. Hallock, Lexington, both of KY (US)

(73) Assignee: Osram Sylvania Inc., Danvers, MA (US)

( * ) Notice: Subject to any disclaimer, the term of this patent is extended or adjusted under 35 U.S.C. 154(b) by 632 days.

(21) Appl. No.: 08/594,964

(22) Filed: Jan. 31, 1996

(51) Int. Cl.[7] ..... H01J 17/22
(52) U.S. Cl. ..... 313/550; 313/546; 313/566
(58) Field of Search ..... 313/550, 546, 313/564, 566, 565; 445/9

(56) References Cited

U.S. PATENT DOCUMENTS

| | | | | |
|---|---|---|---|---|
| 2,283,189 | * | 5/1942 | Cox | 313/546 |
| 4,056,750 | | 11/1977 | Latassa . | |
| 4,282,455 | | 8/1981 | Latassa et al. . | |
| 4,427,919 | | 1/1984 | Grenfell . | |
| 4,553,067 | | 11/1985 | Roche et al. . | |
| 4,754,193 | | 6/1988 | Holmes et al. . | |
| 4,823,047 | | 4/1989 | Holmes et al. . | |
| 5,278,473 | * | 1/1994 | Parks Jr., et al. | 313/546 |

FOREIGN PATENT DOCUMENTS 54-131369 10/1989 (JP) .

* cited by examiner

*Primary Examiner*—Nimeshkumar D. Patel
*Assistant Examiner*—Joseph Williams
(74) *Attorney, Agent, or Firm*—Carlo S. Bessone

(57) ABSTRACT

A lamp includes a sealed transparent elongated envelope containing a gas fill, a coil at each of two ends of the elongated envelope, the coils extending widthwise of the envelope, and lead-in wires connected to each of the coils and connectable to an external source of electric current. The lamp further includes a capsule containing mercury and mounted within the envelope at one of the ends of the envelope, the capsule being connected to one of the lead-in wires of one of the coils, the capsule having a base end disposed in a widthwise plane of the envelope in which is disposed the one coil and disposed adjacent to a center portion of the one coil, the capsule having a body portion extending axially in the envelope toward the other of the coils. The other coil is adapted, upon energization by the current, to emit electrons toward the capsule to heat and burst the capsule, to release the mercury into the envelope. The invention further relates to a method for releasing mercury into a lamp, utilizing the above-described apparatus.

15 Claims, 3 Drawing Sheets

LAMP WITH MERCURY RELEASE STRUCTURE AND METHOD FOR DISPENSING MERCURY INTO A LAMP

FIELD OF THE INVENTION

This invention relates to electric discharge lamps, and is directed more particularly to a fluorescent lamp containing mercury, and to a method for dispensing mercury into a fluorescent lamp.

BACKGROUND OF THE INVENTION

Fluorescent lamps are well-known in the art and are used for a variety of types of lighting installations. Such lamps are characterized as low pressure discharge lamps and include an elongated envelope, whose interior surface is coated with a layer of phosphor, and an electrode at each end of the envelope. The envelope also contains a quantity of an ionizable medium, such as mercury, and a starting gas at a low pressure, generally in the range of 1 to 5 mm Hg. The starting gas may consist of argon, neon, helium, krypton, xenon or a combination thereof.

One of the most commonly used methods for introducing mercury into such lamps is by use of a mechanical dispensing unit which forms part of an "exhaust machine". In such a machine, mercury is dispensed by the action of a slotted plunger passing through a reservoir of mercury and into a closed exhaust chamber housing an exhaust tube. The mercury falls through the exhaust tube into the lamp. This method of dispensing mercury has many drawbacks. The mercury dispensing unit complicates the exhaust machine, and the amount of mercury introduced into the lamp envelope by this method cannot be precisely controlled. Further, the lamp during processing is at a high temperature and is in open communication with the exhaust machine. As a result, it is inevitable that a portion of the introduced mercury evaporates and disappears from the lamp, or a portion of the filling gas is driven out of the lamp. Still further, the introduction of mercury through the exhaust tube involves the risk of mercury getting stuck in the exhaust tube so that after lamp sealing, the lamp contains too little or no mercury at all. For these reasons, an overdose of mercury is required to ensure the lamp retains a minimum amount of mercury. Finally, working with mercury on the exhaust machine requires additional safety precautions on medical grounds.

An alternative method for dispensing mercury is to place inside the lamp a mercury compound that is inert under lamp processing conditions but can later be activated to release mercury. Disadvantageously, this method releases impurities, which then require special gettering. Moreover, this method requires a relatively long period of time to activate the mercury compound, typically 5 to 30 seconds. As a result, this method of dispensing mercury does not readily lend itself to high speed production machinery.

Another method of introducing mercury into an arc discharge lamp is set forth in U.S. Pat. No. 4,553,067, issued on Nov. 12, 1985 to Roche, et al. Therein, a mercury dispensing target is located within an exhausted lamp having a coil at each end of the lamp. The dispensing target is affixed to a lead-in wire adjacent to one of the coils. During processing, the mercury target is heated by bombarding the target with a directed stream of electrons produced by one of the coils, which causes the contained mercury to be released. Although this method reduces mercury release time to about 3 seconds, it is desirable to obtain further reductions.

U.S. Pat. No. 4,870,323, which issued on Sept. 26, 1989, to Parks, Jr., et al, describes a method for dispensing mercury into a fluorescent lamp wherein portions of the mount structure are coated with an insulating coating (e.g., zirconium dioxide). A directed stream of electrons is focused to a portion of the mercury dispensing capsule devoid of the insulating coating. Although this method is effective in reducing the mercury release time, the application of an insulating coating to the various portions of the mount structure may be impractical in commercial production.

There is thus a need for a fluorescent lamp having mercury therein and for a method for dispensing mercury into the lamp, such that the amount of mercury can be precisely controlled, there is no need for introducing excess mercury into the lamp, the mercury can be quickly released into the lamp envelope, there are generated no medical hazards, and the process is readily adaptable for high-speed commercial production of lamps.

SUMMARY OF THE INVENTION

Accordingly, an object of the present invention is to provide a fluorescent lamp having therein a precise amount of mercury, wherein all the mercury introduced into the lamp remains in the lamp and there is no need for providing excess mercury to the lamp to ensure completing the lamp with a required amount of mercury therein.

A further object of the invention is to provide such a lamp as is amenable to high-speed production.

A still further object of the invention is to provide a method for dispensing mercury into a fluorescent lamp envelope, such that a precise amount of contained mercury can be introduced into the envelope and quickly released therein.

A still further object of the invention is to provide such a method as is substantially free from medical hazards.

With the above and other objects in view, as will hereinafter appear, a feature of the present invention is the provision of a fluorescent lamp comprising a sealed transparent elongated envelope containing a gas fill, a coil at each of two ends of the elongated envelope, the coils extending widthwise of the envelope, and lead-in conductors connected to each of the coils and connectable to an external source of electric current. The lamp further comprises a capsule containing mercury and mounted within the envelope at one of the ends of the envelope, the capsule being connected to one of the lead-in conductors of one of the coils, the capsule having a base end disposed in a widthwise plane of the envelope in which is disposed the one coil and disposed adjacent to a center portion of the one coil, the capsule having a body portion extending axially in the envelope toward the other of the coils. The other coil is adapted, upon energization by the electric current, to emit electrons toward the capsule to heat and burst the capsule, to release the mercury into the envelope.

In accordance with a further feature of the invention, there is provided a method for releasing mercury into a fluorescent lamp having a sealed, transparent, elongated envelope with two ends, a coil at each of the two ends, the coils extending widthwise of the envelope, and lead-in conductors connected to each of the coils and connectable to an external source of electric current. The method comprises the steps of providing a capsule containing mercury, mounting the capsule at one of the ends of the envelope by connecting the capsule to one of the lead-in conductors of one of the coils, disposing a base end of the capsule in a widthwise plane of the envelope in which is disposed the one coil, with the capsule extending axially in the envelope toward the other of the coils, and energizing the other coil by the connecting of the lead-in conductors to the source of electric current, to cause emission of electrons from the other coil towards the capsule to heat and burst the capsule, to release the mercury into the envelope.

The above and other features of the invention, including various novel details of construction and combinations of parts, will now be more particularly described with reference to the accompanying drawings and pointed out in the claims. It will be understood that the particular device and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown illustrative embodiments of the invention, from which its novel features and advantages will be apparent.

In the drawings.

DESCRIPTION OF THE PREFERRED EMBODIMENTS

Figure 1:
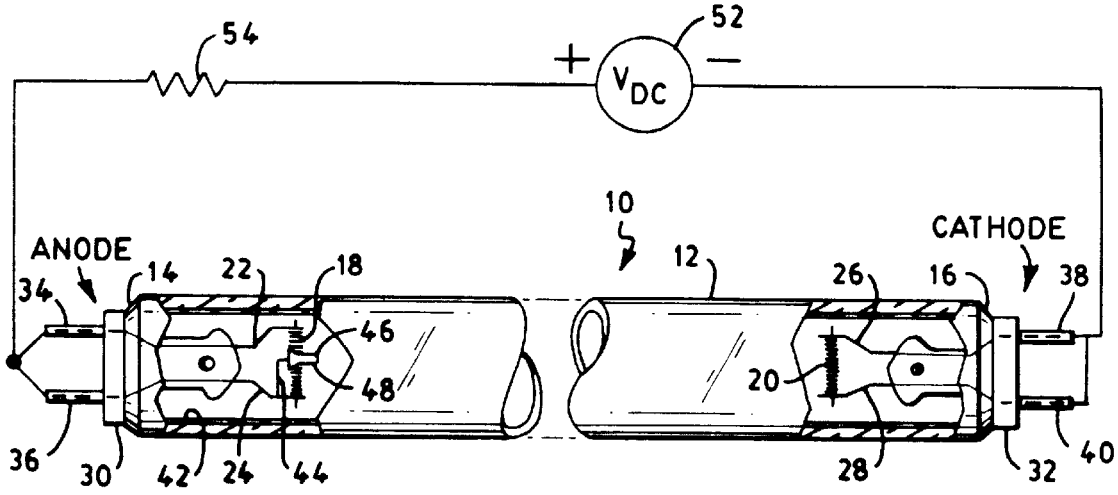
FIG. 1 is a side elevational view, broken away and partly in section, of one form of fluorescent lamp illustrative of an embodiment of the invention.
Figure 2:
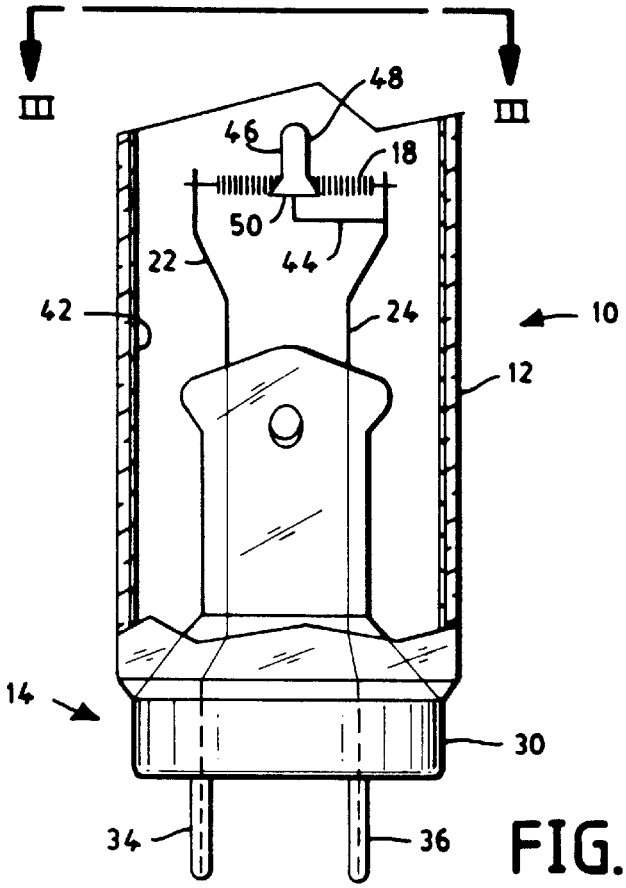
FIG. 2 is an elevational view, broken away and partly in section, of a portion of the lamp of FIG. 1.
Figure 3:
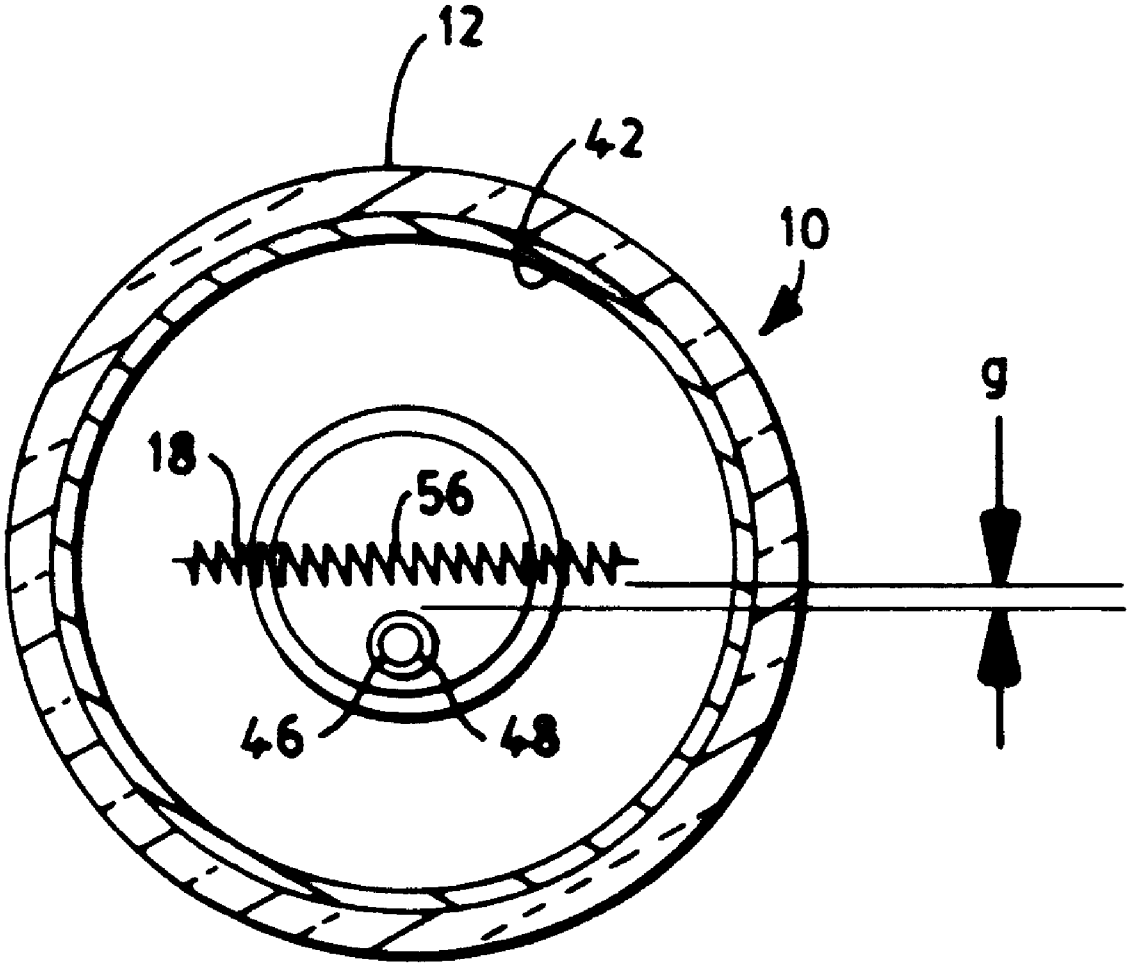
FIG. 3 is a view taken along line III—III of FIG. 2.

Referring now to the drawings, there is shown in FIGS. 1–3 an arc discharge lamp 10 (e.g., a fluorescent lamp) having a sealed elongated envelope 12 of light-transmitting vitreous material. The envelope 12 has opposing end portions 14, 16, and encloses an inert starting gas, which may be argon, neon, helium, krypton, xenon, or a combination thereof, at a low pressure in the range of about 1 to 5 mm Hg.

A first coil electrode 18 and a second coil electrode 20 are located within opposing end portions 14 and 16, respectively. Coils 18, 20 may be coated with electron-emitting materials, such as BaO—SrO—CaO containing $MZrO_3$. A first pair of lead-in wires 22, 24, connect to first electrode 18 and a second pair of lead-in wires 26, 28, connect to second coil 20. Suitable bases 30, 32, carrying contacts 34, 36 and 38, 40 are respectively sealed adjacent to the end portions 14, 16. Lead-in wires 22, 24, and 26, 28 are electrically connected to contacts 34, 36, and 38, 40, respectively.

A phosphor coating 42 may be disposed on the interior surface of the envelope 12. The phosphor coating 42 is responsive to the ultraviolet radiation generated by the plasma discharge to provide the desired emission spectrum.

As further shown in FIGS. 1–3, fluorescent lamp 10 contains a mercury dispensing target, such as a metal capsule 46, connected to a support wire 44 connected to a lead-in wire 24 and disposed adjacent to first coil 18.

The mercury capsule 46 has a tubular-shaped main body portion 48 which encloses a quantity of liquid mercury prior to processing. The mercury is sealed within the main body portion 48 of the capsule 46 by means of a flattened base end portion 50. The mercury may be sealed within the capsule, for example, by utilizing teachings of U.S. Pat. No. 4,754,193 issued on Jun. 28, 1988 to James L. Holmes, et al.

The basic circuit arrangement for utilizing electron current to release the mercury is shown in FIG. 1 as comprising a lamp ballast 54 to regulate the current and a DC power supply 52. Power supply 52 may include a full-wave bridge rectifier (not shown) to transform AC voltage from the line to DC. The end 14 of the lamp 10, containing the mount to which the mercury capsule 46 is attached, is connected to the positive side of the power supply 52. Contacts 38 and 40 of base 32, located at the end 16 of lamp 10, are connected to the negative side of the power supply 52.

The current drawn through fluorescent lamp 10 during the capsule rupturing process is essentially electron current. The primary source of electron current within lamp 10 is the lamp cathode which, in the d.c. circuit, is the electrode 20 connected to the negative side of the power supply 52. The primary electron current generates secondary electrons through an ionization process in the positive column of the evacuated, filled and sealed lamp. These electrons have a velocity established by the lamp field in the direction from cathode-to-anode. Electrons arriving at the positive end (i.e., anode) of the lamp are collected by the electrode coil 18, the lead-in wires 22, 24, and the mercury capsule 46. The rate at which the capsule temperature increases is proportional to the amount of electrons collected. Inasmuch as capsule rupture is caused by an increase in capsule temperature, it is evident that the faster the capsule heats up, the lower the rupture time will be.

Although the rupture circuit illustrated in FIG. 1 uses direct current, the lamp is generally intended for use on an alternating current circuit.

Referring again to FIGS. 1–3, it will be seen that in accordance with the present invention the capsule 46 is disposed in the lamp 10 such that the base end 50 of the capsule 46 is disposed in a widthwise plane of the envelope in which is disposed the first coil 18. The capsule elongated body portion 48 extends axially in the envelope 12 toward the second coil 20. The base end 50 of the capsule 46 is disposed adjacent to a central portion 56 of the first coil 18 and the body portion 48 of the capsule extends normal to the plane of the coil 18 and along a central axis of the envelope 12 toward the end portion 16 of the lamp 10. The base end 50 of the capsule 46 and the coil 18 define therebetween a gap g (FIG. 3.) of about 1/32–1/4 inch in the widthwise plane of the coil 18. The smaller the gap, the more rapid the heating and bursting of the capsule 46 to free the mercury, which is vaporized by the heat.

Figure 4:
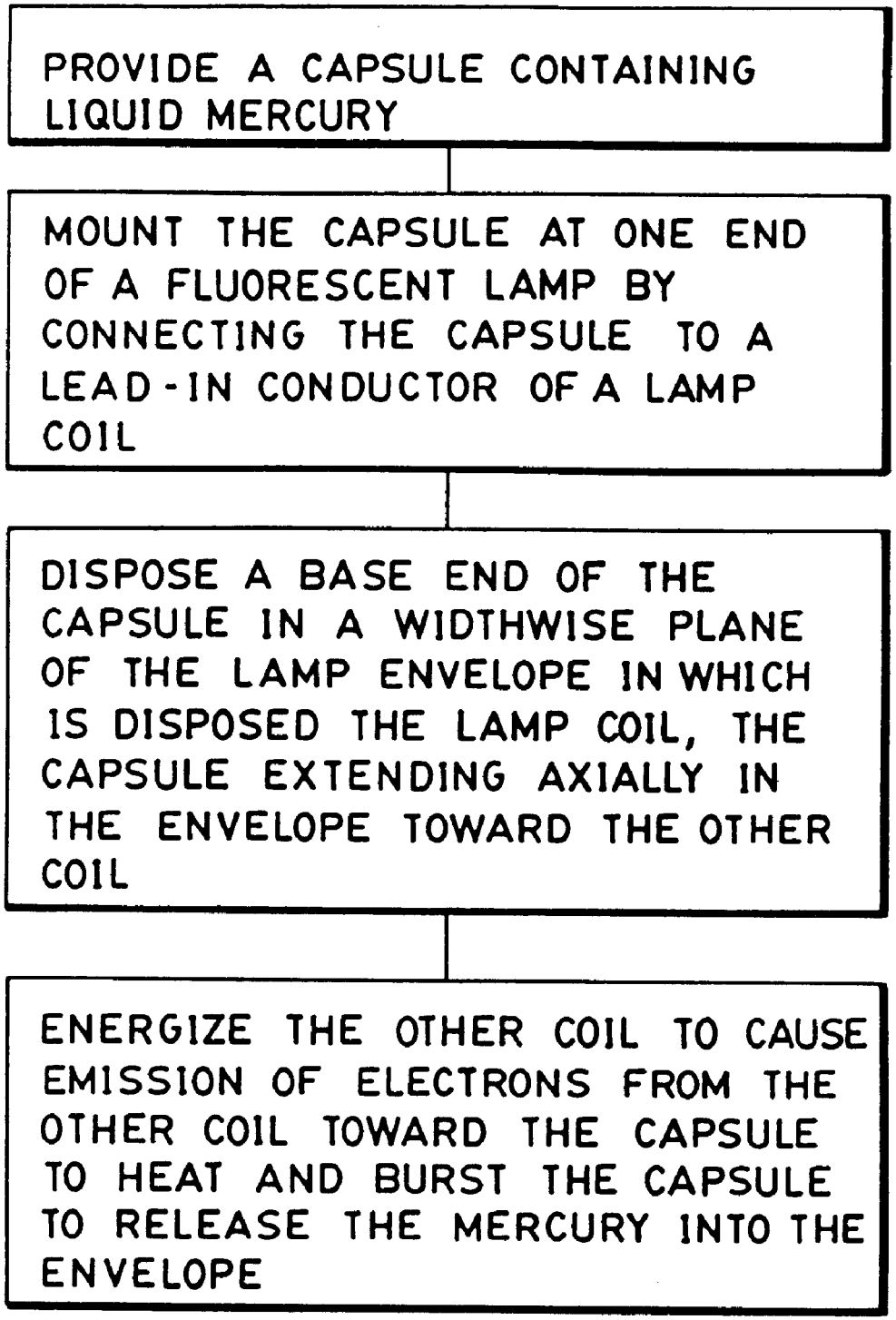
FIG. 4 is a chart illustrating a sequence of steps in the inventive method.

A method set forth hereinbelow facilitates the release of mercury into the fluorescent lamp 10 having the sealed, transparent, elongated envelope 12 with first and second ends 14, 16, the coils 18, 20 at each of the ends 14, 16, respectively, the coils 18, 20 extending widthwise of the envelope 12, and lead-in wires 22, 24, and 26, 28 connected to each of the coils 18, 20, respectively. The method includes the steps of (FIG. 4) providing a capsule 46 containing liquid mercury, and mounting the capsule 46 at the first end 14 of the envelope 12 by connecting the capsule 46, by way of support wire 44, to the lead-in wire 24. In positioning of the capsule 46, the base end 50 thereof is disposed in a widthwise plane of the envelope 12 in which is disposed the first coil 18, with the capsule body portion 48 extending axially in the envelope 12 toward the second coil 20. The coil 20 is energized by connecting one of the lead-in wires 26, 28 to the power supply 52 to cause emission of electrons from the coil 20 toward the capsule 46 to heat and burst the capsule, to release vaporized mercury into the envelope.

As noted above, the capsule base end 50 is positioned adjacent to the center portion 56 of the first coil 18 (FIG. 3), and preferably is spaced from the coil 18 by about 1/32–1/4 inch.

It has been found that utilization of the above-described apparatus and method in the production of 40 watt lamps results in release of mercury into the lamps in an average time of about 1 second, whereas using a capsule welded directly to a lead wire of a 40 watt lamp results in a longer release time, averaging greater than 3 seconds. Thus, placing the capsule in the position described herein substantially reduces the release time required, from an average of about 3 seconds to an average of about 1 second. While even further reduction may be obtained by leaving the anode leads open, rather than in common, the lead wire to which the capsule is molded must be known in the manufacturing process, which is an impractical requirement in most production lines.

It is to be understood that the present invention is by no means limited to the particular construction herein disclosed and/or shown in the drawings, but also comprises any modifications or equivalents within the scope of the claims.

Having this described our invention, what we claim as new and desire to secure by Letters Patent of the United States is:

1. A lamp comprising:

a sealed transparent elongated envelope containing a gas fill;

a coil at each of two ends of said elongated envelope, said coils extending widthwise of said envelope;

first and second lead-in wires connected to each of said coils and connectable to an external source of electric current; and a capsule containing mercury and mounted within said envelope at one of said ends of said envelope, said capsule being connected to one of said first and second lead-in wires of one of said coils, said capsule being disposed adjacent to a center portion of said one coil and having a body portion extending axially in said envelope toward the other of said coils;

said other coil being adapted, upon energization by said current, to emit electrons toward said capsule to heat and burst said capsule, to release said mercury into said envelope.

2. The lamp in accordance with claim 1 wherein said capsule has a base end disposed in a widthwise plane of said envelope in which is disposed said one coil.

3. The lamp in accordance with claim 1 wherein said base end of said capsule is fixed to a support wire extending from said one lead-in wire.

4. The lamp in accordance with claim 2 wherein said center portion of said one coil and said capsule define a gap therebetween, in said widthwise plane, of about 1/32–1/4 inch.

5. The lamp in accordance with claim 1 wherein said capsule is elongated and extends substantially along a central axis of said lamp, substantially normal to said one coil.

6. The lamp in accordance with claim 1 wherein said gas comprises a gas selected from a group of gases consisting of argon, xenon, krypton, helium, neon, and combinations thereof.

7. The lamp in accordance with claim 1 wherein said mercury is in liquid form in said capsule prior to said bursting of said capsule.

8. The lamp in accordance with claim 1 wherein said capsule is of metal.

9. A method for releasing mercury into a lamp having a sealed, transparent, elongated envelope with two ends, a coil at each of said two ends, said coils extending widthwise of said envelope, and first and second lead-in wires connected to each of said coils and connectable to an external source of electric current, said method comprising the steps of:

providing a capsule containing mercury;

mounting said capsule at one of said ends of said envelope by connecting said capsule to one of said lead-in wires of one of said coils;

disposing said capsule adjacent to a center portion of said one coil, with a body portion of said capsule extending axially in said envelope toward the other of said coils; and energizing said other coil by said connecting of said lead-in wires to said source of electric current, to cause emission of electrons from said other coil toward said capsule to heat and burst said capsule, to release said mercury into said envelope.

10. The method in accordance with claim 9 wherein said capsule has a base end disposed in a widthwise plane of said envelope in which is disposed said one coil.

11. The method in accordance with claim 9 wherein said capsule is connected to said one lead-in wire by fixing said base end of said capsule to a first end of a support wire, and fixing a second end of said support wire to said one lead-in wire.

12. The method in accordance with claim 9 wherein said mercury is liquid mercury.

13. The method in accordance with claim 9 wherein said capsule is positioned adjacent to said center portion of said one coil so as to form therebetween a gap of about 1/32–1/4 inch.

14. The method in accordance with claim 12 wherein said capsule is of metal.

15. The method in accordance with claim 12 wherein said capsule is heated to vaporize said mercury therein and to burst said capsule to release said vaporized mercury.

* * * * *